US011226149B2

(12) United States Patent
Mitsushima

(10) Patent No.: US 11,226,149 B2
(45) Date of Patent: Jan. 18, 2022

(54) AIR-CONDITIONING APPARATUS

(71) Applicant: Mitsubishi Electric Corporation, Tokyo (JP)

(72) Inventor: Kazuaki Mitsushima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 16 days.

(21) Appl. No.: 16/650,024

(22) PCT Filed: Nov. 29, 2017

(86) PCT No.: PCT/JP2017/042824
§ 371 (c)(1),
(2) Date: Mar. 24, 2020

(87) PCT Pub. No.: WO2019/106755
PCT Pub. Date: Jun. 6, 2019

(65) Prior Publication Data
US 2020/0278146 A1 Sep. 3, 2020

(51) Int. Cl.
*F25D 21/00* (2006.01)

(52) U.S. Cl.
CPC ..... *F25D 21/006* (2013.01)

(58) Field of Classification Search
CPC ..... F25B 2339/04; F25B 2339/045; F25B 2339/046; F25B 47/02; F25B 47/022;
(Continued)

(56) References Cited

U.S. PATENT DOCUMENTS 4,313,313 A * 2/1982 Chrostowski ..... F25B 13/00 62/196.4
5,076,353 A * 12/1991 Haussmann ..... F28D 1/05325 165/110
(Continued)

FOREIGN PATENT DOCUMENTS

EP 1 031 801 A2 8/2000
GB 2545112 A 6/2017
(Continued)

OTHER PUBLICATIONS

Extended European Search Report dated Nov. 20, 2020 issued in corresponding European patent application No. 17933432.1.
(Continued)

*Primary Examiner* — Nelson J Nieves
(74) *Attorney, Agent, or Firm* — Posz Law Group, PLC

(57) ABSTRACT

The air-conditioning apparatus has a refrigeration cycle for circulating refrigerant by connecting a compressor, a four-way valve, an outdoor heat exchanger, an expansion valve, and an indoor heat exchanger in this order with refrigerant pipes. The outdoor heat exchanger includes a plurality of heat transfer fins, a heat transfer tube having a plurality of paths, a distributor configured to branch, at an intermediate portion of the heat transfer fin, a refrigerant flow path into an upper path and a lower path of the heat transfer tube, a first temperature detecting unit configured to detect a refrigerant temperature merged through the distributor, a second temperature detecting unit configured to detect a refrigerant temperature of a refrigerant passing through the lower path, and a controller for performing control for terminating the defrosting operation when the refrigerant temperature detected by the first temperature detecting unit reaches the first target temperature and the refrigerant temperature detected by the second temperature detecting unit reaches
(Continued)

the second target temperature during the defrosting operation.

2 Claims, 6 Drawing Sheets

(58) Field of Classification Search
CPC ..... F25B 2347/02; F25B 2347/021; F25B 2347/022; F25B 2347/023; F25B 2400/0417; F25D 21/002; F25D 21/004
See application file for complete search history.

(56) References Cited

U.S. PATENT DOCUMENTS 5,105,629 A * 4/1992 Parris ..... F24F 1/022 62/278
5,263,892 A * 11/1993 Vandervaart ..... F25B 30/06 165/240
7,845,185 B2 * 12/2010 Knight ..... F24F 3/153 62/196.4
9,568,206 B2 * 2/2017 Tutunoglu ..... F24F 11/30
10,976,085 B2 * 4/2021 Onaka ..... F25B 39/02
2005/0044882 A1 * 3/2005 Hong ..... F25B 39/04 62/507
2010/0057263 A1 * 3/2010 Tutunoglu ..... F25B 49/027 700/282
2010/0170270 A1 * 7/2010 Jang ..... F25B 47/022 62/81
2010/0293980 A1 * 11/2010 Shimaoka ..... F25B 41/45 62/259.1
2012/0118533 A1 * 5/2012 Jang ..... F28F 27/02 165/96
2013/0192809 A1 * 8/2013 Kim ..... F28F 1/00 165/175
2014/0116078 A1 * 5/2014 Doumyou ..... F28D 1/0477 62/238.6
2015/0047385 A1 * 2/2015 Albertson ..... F25B 39/028 62/324.6
2016/0033179 A1 * 2/2016 Kim ..... F25B 30/02 62/324.6
2016/0348951 A1 * 12/2016 Matsumura ..... F28D 1/0475
2017/0153050 A1 * 6/2017 Nakagawa ..... F25B 31/006
2017/0268790 A1 * 9/2017 Yokozeki ..... F25B 40/02
2017/0328614 A1 * 11/2017 Yokozeki ..... F25B 39/04
2018/0266743 A1 * 9/2018 Watanabe ..... F25B 47/025
2019/0093965 A1 * 3/2019 Higashiiue ..... F28F 9/0278
2019/0154321 A1 * 5/2019 Takenaka ..... F25B 13/00
2019/0162454 A1 * 5/2019 Hatomura ..... F24F 11/43
2019/0168582 A1 * 6/2019 Sun ..... F28D 1/0443
2020/0025427 A1 * 1/2020 Higashiiue ..... F25B 39/00
2020/0072507 A1 * 3/2020 Higashiiue ..... F25B 39/028
2020/0072517 A1 * 3/2020 Kato ..... F28F 9/262

FOREIGN PATENT DOCUMENTS

JP H06-026689 A 2/1994
JP H08-075326 A 3/1996
JP 2000-249479 A 9/2000
JP 2007-040589 A 2/2007
JP 2007-198711 A 8/2007
JP 2007-232274 A 9/2007

OTHER PUBLICATIONS

International Search Report of the International Searching Authority dated Feb. 13, 2018 for the corresponding international application No. PCT/JP2017/042824 (and English translation).
Japanese Office Action dated Feb. 2, 2021, issued in corresponding JP Patent Application No. 2019-556459 (and English Machine Translation).

* cited by examiner

AIR-CONDITIONING APPARATUS

CROSS REFERENCE TO RELATED APPLICATIONS

This application is a U.S. national stage application of PCT/JP2017/042824 filed on Nov. 29, 2017, the contents of which are incorporated herein by reference.

TECHNICAL FIELD

The present disclosure relates to an air-conditioning apparatus having a refrigeration cycle for circulating refrigerant by connecting a compressor, a four-way valve, an outdoor heat exchanger, an expansion valve, and an indoor heat exchanger in order by refrigerant pipes.

BACKGROUND ART

Generally, an air-conditioning apparatus includes an outdoor unit installed outdoors and an indoor unit installed indoors, and has a refrigeration cycle for circulating refrigerant by connecting a compressor, a four-way valve, an outdoor heat exchanger, an expansion valve, and an indoor heat exchanger in this order by refrigerant pipes. In air-conditioning apparatuses, when heating operation is performed in a humid environment at a low outside air temperature of about 0 degrees C., water vapor in the atmosphere condenses, and dew condensation occurs on the surfaces of the heat transfer fins of the outdoor heat exchanger. When the temperature of the outdoor heat exchanger falls below the freezing point, the condensation water changes to frost and causes clogging between the heat transfer fins. In the outdoor heat exchanger, when the space between the heat transfer fins are clogged, ventilation is inhibited, so that heat transfer amounts between the refrigerant and air are reduced, and the temperature of the heat transfer tube is lowered. As a result, in air-conditioning apparatus, the refrigerant evaporates poorly, and the heating capacity decreases.

Therefore, the air-conditioning apparatuses regularly perform defrosting operation (cooling operation) in which discharge hot gas of the compressor are directly flowed to the outdoor heat exchanger. For example, in the air-conditioning apparatus disclosed in Patent Literature 1, the defrosting operation is performed on the basis of the refrigerant temperature detected by the temperature detection unit provided at the outdoor heat exchanger.

Incidentally, during the heating operation in the case where the outside air has a positive low temperature (for example, about 5 degrees C.) and is humid (for example, about 90% of humidity), frost may grow and become thick ice in some cases. The thick ice may remain in the outdoor heat exchanger without being melted within a period of time despite defrosting operations. Therefore, in the air-conditioning apparatus, measures are taken to forcibly extend the defrosting operation for a certain period of time and to enhance the capacity to melt ice even after the temperature detected by the temperature detection unit reaches the temperature at which the defrosting operation is terminated.

CITATION LIST

Patent Literature

[Patent Literature 1] JP-A-06-026689

SUMMARY OF INVENTION

Technical Problem

The above-mentioned extension of the defrosting operation is also applied even under a cryogenic environment of −10 degrees C. in which the absolute humidity is low and the heat exchanger is not frosted. During the defrosting operation, the fan is stopped to prevent cold air from being applied to users. During this period, since heating capacity is not exerted, the room temperature drops. During the defrosting operation, refrigerant in the indoor heat exchanger is not vaporized by fan, so that liquid refrigerant is suctioned to compressor. If the defrosting operation is unnecessarily extended in the air-conditioning apparatus, the liquid compression volume increases and damaging to components in the compressor increases. In addition, the concentration of the lubricating oil in the compressor is lowered, and burning of the sliding portion is expected due to insufficient lubrication. Therefore, the air-conditioning apparatus needs to perform the defrosting operation for the minimum necessary duration.

The present disclosure has been made to overcome the above-mentioned problems, and the air-conditioning apparatus of the present disclosure aims to provide an air-conditioning apparatus capable of performing defrosting operation for the minimum necessary duration.

Solution to Problems

The air conditioner includes a refrigeration cycle in which a compressor, a four-way valve, an outdoor heat exchanger, an expansion valve, and an indoor heat exchanger are connected in order by refrigerant pipes to circulate refrigerant, wherein the outdoor heat exchanger includes a plurality of heat transfer fins arranged in parallel at intervals, a heat transfer tube connected with and penetrating through the plurality of heat transfer fins and having a plurality of paths in the vertical direction of the heat transfer fin, a distributor configured to branch, at an intermediate portion of the heat transfer fin, a refrigerant flow path into an upper path and a lower path of the heat transfer tube, a first temperature detecting unit configured to detect a temperature of merged refrigerant into which refrigerant flowing through the upper path and refrigerant flowing through the lower path merge through the distributor, a second temperature detecting unit configured to detect a refrigerant temperature of the refrigerant passing through the lower path, and a controller configured to perform control to terminate defrosting operation when the refrigerant temperature detected by the first temperature detecting unit reaches a first target temperature and the refrigerant temperature detected by the second temperature detecting unit reaches a second target temperature during the defrosting operation.

Advantageous Effects of Invention

According to the air-conditioning apparatus of the present disclosure, when ice is generated in the lower part of the outdoor heat exchanger, the defrosting operation is extended until the refrigerant temperature detected by the second temperature detecting unit reaches the second target temperature, and the capability of melting the ice is enhanced. On the other hand, when ice is not generated in the lower part of the outdoor heat exchanger, the defrosting operation is hardly extended because there is almost no difference between the refrigerant temperature detected by the first temperature detecting unit and the refrigerant temperature detected by the second temperature detecting unit. Therefore, in this air-conditioning apparatus, ice can be effectively melted when ice is generated in the lower part of the outdoor heat exchanger, and extra defrosting operation is not performed unless ice is generated in the lower part of the outdoor heat exchanger, so that the defrosting operation can be performed for the minimum necessary duration.

DESCRIPTION OF EMBODIMENTS

Figure 1:
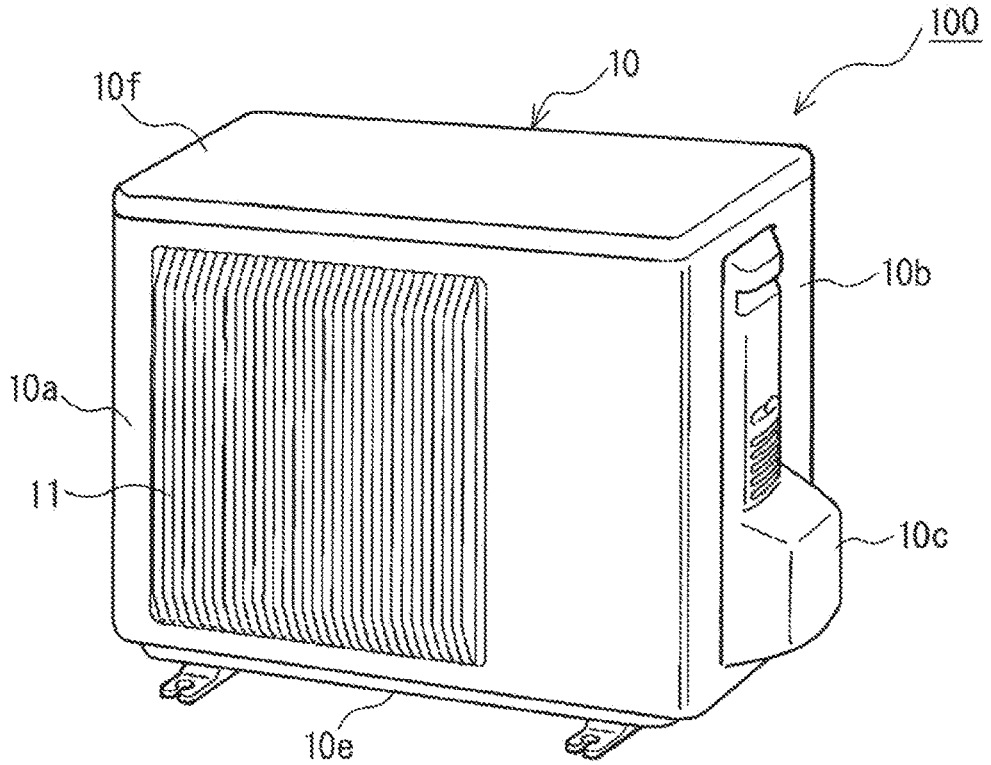
FIG. 1 is a perspective view showing the exterior of the outdoor unit of the air-conditioning apparatus according to an embodiment of the present disclosure.

An Embodiment of the present disclosure will be described below with reference to the drawings. In the drawings, the same or equivalent referents are denoted by the same reference numerals, and the description thereof is omitted or simplified as appropriate. The shape, size, arrangement, and the like of the configurations shown in the drawings can be appropriately changed within the scope of the present disclosure.

Embodiment

Figure 2:
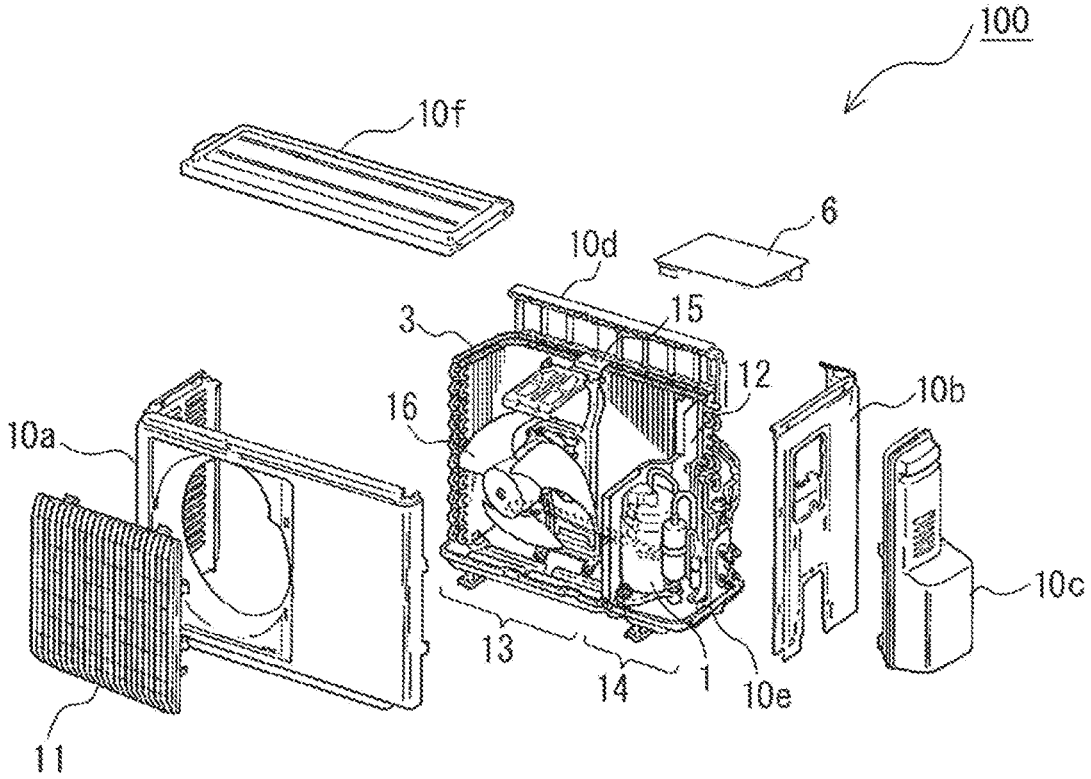
FIG. 2 is an exploded perspective view of an outdoor unit of an air-conditioning apparatus according to an embodiment of the present disclosure.
Figure 3:
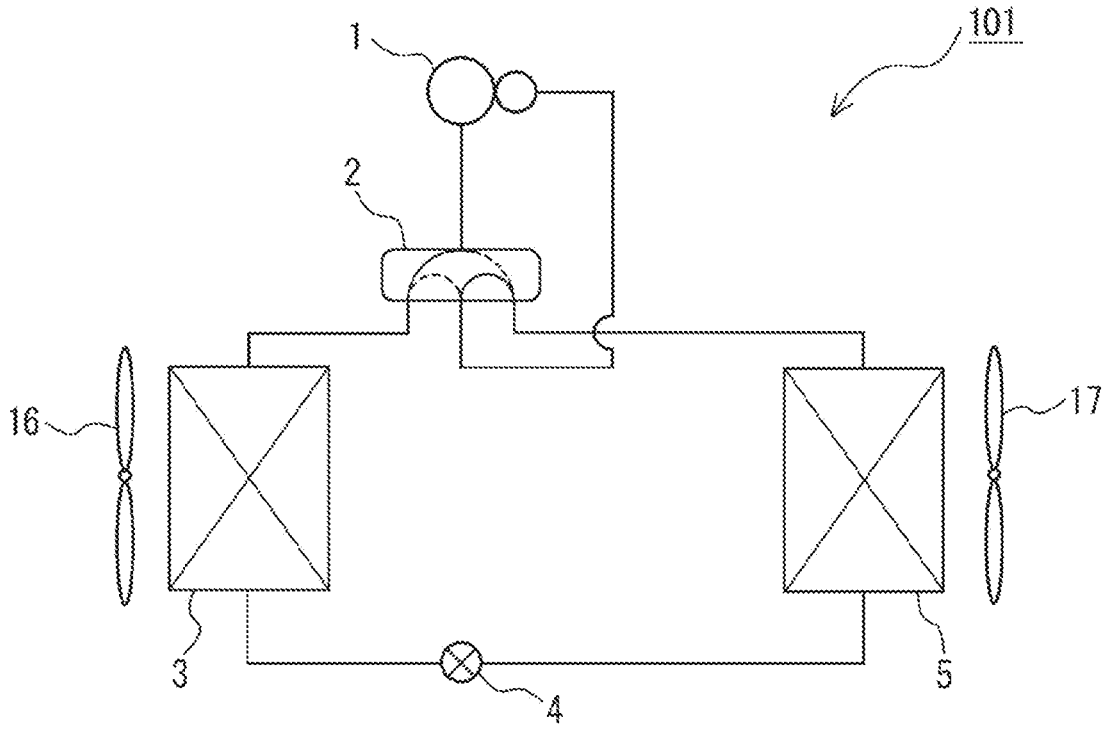
FIG. 3 is a refrigerant circuit diagram showing a refrigeration cycle of an air-conditioning apparatus according to an embodiment of the present disclosure.

First, the overall configuration of the air-conditioning apparatus according to the present embodiment will be described with reference to FIGS. 1 to 3. FIG. 1 is a perspective view showing an external view of an outdoor unit of an air-conditioning apparatus according to an embodiment of the present disclosure. FIG. 2 is an exploded perspective view of an outdoor unit of an air-conditioning apparatus according to an embodiment of the present disclosure. FIG. 3 is a refrigerant circuit diagram showing the refrigeration cycle of an air-conditioning apparatus according to an embodiment of the present disclosure.

The air-conditioning apparatus according to the present embodiment includes an outdoor unit 100 installed outdoors as shown in FIGS. 1 and 2, and an indoor unit installed indoors (not shown). As shown in FIG. 3, the air-conditioning apparatus has a refrigeration cycle 101 configured by connecting the compressor 1, the four-way valve 2, the outdoor heat exchanger 3, the expansion valve 4, which is a pressure reducing device, and the indoor heat exchanger 5 in this order by refrigerant pipe to circulate refrigerant.

As shown in FIGS. 1 and 2, the outdoor unit 100 has a casing 10 that is the exterior thereof. The casing 10 includes, for example, a front panel 10*a* defining a left side surface and a front surface, a right side panel 10*b* defining a right side surface, a right side cover 10*c* covering an opening of the right side panel 10*b*, a rear panel 10*d* defining a rear surface, a bottom plate 10*e* defining a bottom surface, and a top plate 10*f* defining a top surface. The front panel 10*a* is provided with a fan grille 11 so as to cover a round-shaped air outlet formed in the front panel.

The interior of the casing 10 is partitioned into a fan chamber 13 and a machinery chamber 14 by a partition plate 12. The fan chamber 13 accommodates an outdoor heat exchanger 3 provided to face the left side surface to the entire rear surface of the outdoor unit 100, a mounting plate 15 provided to extend along the vertical direction of the outdoor heat exchanger 3, and a fan 16 mounted on the mounting plate 15. The machinery chamber 14 accommodates a compressor 1 provided on the upper surface of a bottom plate 10*e* and a controller 6 provided above the compressor 1. The controller 6 is composed of hardware such as a circuit device or software executed on a computing device such as a microcomputer or a CPU, and controls the outdoor unit 100. The refrigerant delivered from the indoor unit is compressed in the compressor 1 and sent to the outdoor heat exchanger 3 through the refrigerant pipe.

The compressor 1 is for suctioning and compressing of refrigerant and discharging it at a high temperature and a high pressure. The compressor 1 is composed of, for example, a capacitance-controllable inverter compressor or the like. The four-way valve 2 has a function of switching the flow path of the refrigerant. In the heating operation, the four-way valve 2 allows refrigerant communication between the discharge side of the compressor 1 and the indoor heat exchanger 5, and switches the refrigerant flow path so as to allow refrigerant communication between the suction side of the compressor 1 and the outdoor heat exchanger 3, as indicated by the broken line in FIG. 3. In the cooling operation, as shown by the solid line in FIG. 3, the four-way valve 2 allows refrigerant communication between the discharge side of the compressor 1 and the outdoor heat exchanger 3, and switches the refrigerant flow path so as to allow refrigerant communication between the suction side of the compressor 1 and the indoor heat exchanger 5.

The outdoor heat exchanger 3 functions as a condenser during the cooling operation, and exchanges heat between refrigerant discharged from the compressor 1 and air. The outdoor heat exchanger 3 functions as an evaporator during the heating operation, and exchanges heat between the refrigerant flowing out of the expansion valve 4 and the air. One side of the outdoor heat exchanger 3 is connected to the four-way valve 2, and the other side of the outdoor heat exchanger 3 is connected to the expansion valve 4.

The expansion valve 4 is a valve for reducing the pressure of the refrigerant passing through the evaporator, and is composed of, for example, an electronic expansion valve capable of adjusting the opening degree.

The indoor heat exchanger 5 is housed in the indoor unit together with the fan 17. The indoor heat exchanger 5 functions as an evaporator during the cooling operation, and exchanges heat between the refrigerant flowing out of the expansion valve 4 and the air. The indoor heat exchanger 5 functions as a condenser during the heating operation, and exchanges heat between the refrigerant discharged from the compressor 1 and the air. One side of the indoor heat exchanger 5 is connected to the four-way valve 2, and the other side of the indoor heat exchanger 5 is connected to the expansion valve 4.

Next, the refrigerant flow of the refrigeration cycle 101 during the heating operation will be described with reference to FIG. 3. In the heating operation, the four-way valve 2 is operated by the refrigeration cycle 101 switched to the state indicated by the broken line in FIG. 3. The high-temperature and high-pressure gas refrigerant discharged from the compressor 1 flows into the indoor heat exchanger 5 via the four-way valve 2. At this time, the indoor heat exchanger 5 functions as a condenser. The refrigerant rejects heat to the ambient within the indoor space and changes to high-pressure liquid refrigerant. The liquid refrigerant flows out of the indoor heat exchanger 5, is decompressed and expanded by the expansion valve 4, becomes low-temperature, low-pressure two-phase gas-liquid refrigerant, and then flows into the outdoor heat exchanger 3. At this time, the outdoor heat exchanger 3 functions as an evaporator. The refrigerant absorbs heat from the outdoor environment and changes to low-temperature, low-pressure gases refrigerant. Thereafter, the gas refrigerant returns to the compressor 1 via the four-way valve 2, where it is discharged as a high-temperature, high-pressure gas refrigerant, and circulates through the refrigeration cycle 101.

In the heating operation, when the outside air temperature is low and the outside air humidity is high, moisture in the air in contact with the outdoor heat exchanger 3 reaches the dew point, condenses, frosts, and adheres to the surfaces of the heat transfer fins 30. If these frosts deposit on the surfaces of the heat transfer fins 30, heat exchange efficiencies are lowered, resulting in a reduction in heating capacity. Therefore, when the air-conditioning apparatus performs heating operation for a prolonged period, defrosting operation (cooling operation) which is the reverse of the heating operation needs to be performed periodically to remove the frost.

Next, the refrigerant flow of the refrigeration cycle 101 in the defrosting operation (cooling operation) will be described with reference to FIG. 3. In the defrosting operation, the four-way valve 2 is switched to the solid line side in FIG. 3 by the controller 6, and the operation is performed by the refrigeration cycle 101. The high-temperature and high-pressure gas refrigerant discharged from the compressor 1 flows into the outdoor heat exchanger 3 via the four-way valve 2. At this time, the outdoor heat exchanger 3 functions as a condenser. The refrigerant rejects heat to the ambient of the outdoor space, which melts the frost adhering to it during heating operation. The high-pressure liquid refrigerant changed by the outdoor heat exchanger 3 flows out of the outdoor heat exchanger 3, is decompressed and expanded by the expansion valve 4, becomes a low-temperature and low-pressure two-phase gas-liquid refrigerant, and then flows into the indoor heat exchanger 5. At this time, the indoor heat exchanger 5 functions as an evaporator. The refrigerant absorbs heat from the room environment and changes to low temperature, low pressure gas refrigerant. Thereafter, the gas refrigerant returns to the compressor 1 via the four-way valve 2, where it is discharged as a high-temperature, high-pressure gas refrigerant, and circulates through the refrigeration cycle 101.

Figure 4:
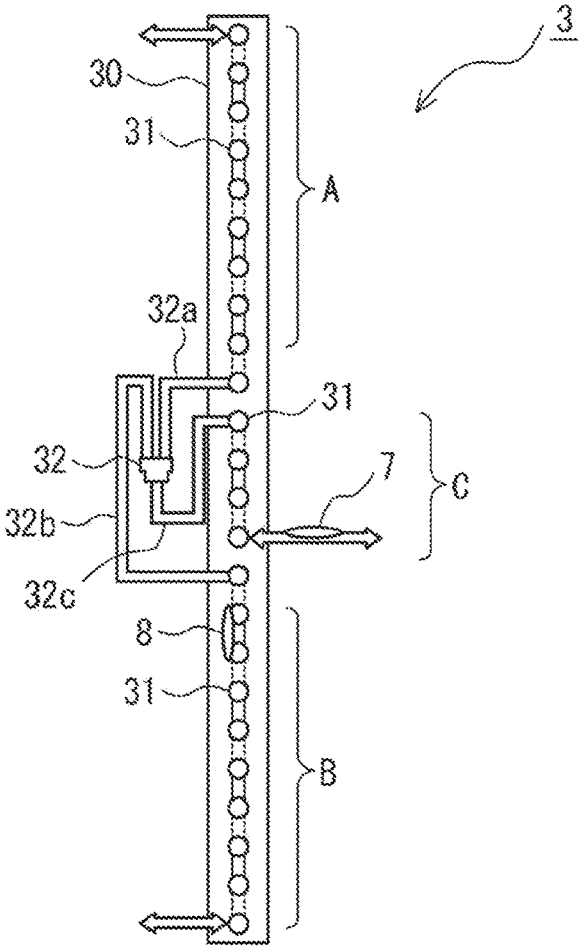
FIG. 4 is an explanatory diagram schematically showing a longitudinal sectional view of the outdoor heat exchanger of the air-conditioning apparatus according to an embodiment of the present disclosure.
Figure 5:
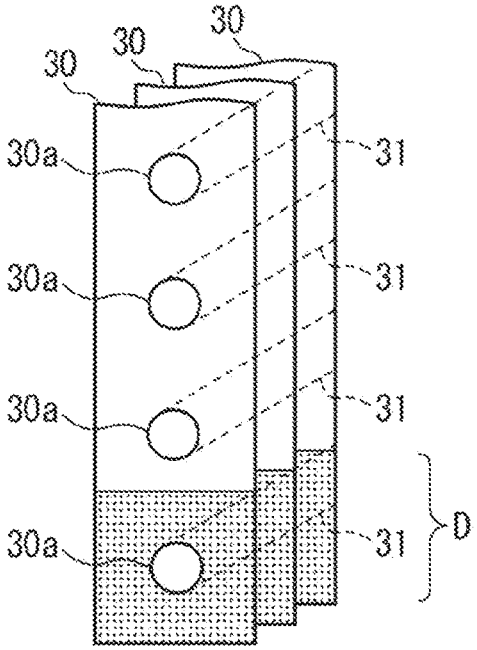
FIG. 5 is an explanatory diagram schematically showing the heat transfer fins constituting the outdoor heat exchanger of the air-conditioning apparatus according to an embodiment of the present disclosure.

Next, details of the outdoor heat exchanger 3 will be described with reference to FIGS. 4 and 5. FIG. 4 is an explanatory diagram schematically showing a vertical cross section of an outdoor heat exchanger of the air-conditioning apparatus according to the embodiment of the present disclosure. FIG. 5 is an explanatory diagram schematically showing heat transfer fins constituting the outdoor heat exchanger of the air-conditioning apparatus according to the embodiment.

As shown in FIGS. 4 and 5, the outdoor heat exchanger 3 is a fin-tube heat exchanger composed of a plurality of heat transfer fins 30 arranged in parallel at intervals so that plate-like surfaces are substantially parallel, and a heat transfer tube 31 connected with and penetrating through the heat transfer fins 30 and having a plurality of paths in the vertical directions of the heat transfer fins 30. The heat transfer fins 30 are formed of a material such as aluminum, for example, and are in contact with the heat transfer tube 31 to increase the heat transfer area. As shown in FIG. 5, a plurality of heat transfer tube inserting holes **30*a* for passing the heat transfer tube 31 are formed in the vertical direction (longitudinal direction) of the heat transfer fins 30**.

The heat transfer tube 31 transfers the heat of the refrigerant passing through the inside of the pipe to the air passing through the outside of the pipe. As shown in FIG. 4, the heat transfer tube 31 includes an upper path A and a lower path B having a refrigerant outlet during the heating operation, and an intermediate path C having an refrigerant inlet during the heating operation. The outdoor heat exchanger 3 has an uppermost portion and a lowermost portion serving as refrigerant outlets during the heating operation. On the other hand, in the outdoor heat exchanger 3, the uppermost portion and the lowermost portion serve as refrigerant inlets during the defrosting operation.

The outdoor heat exchanger 3 has a distributor 32 for branching the refrigerant flow path connected to the intermediate path C located at the intermediate portion of the heat transfer fins 30 into an upper path A and a lower path B of the heat transfer tube 31. The distributor 32 is connected by a connecting pipe **32*c* to the heat transfer tube 31 which constitutes the intermediate path C. The first branch pipe 32*a* branched by the distributor 32 is connected to the lower end of the heat transfer tube 31 constituting the upper path A. The second branch pipe 32*b* branched by the distributor 32 is connected to the upper end of the heat transfer tube 31** constituting the lower path B.

The outdoor heat exchanger 3 further includes a first temperature detecting unit 7 for detecting the refrigerant temperature at which the refrigerant flowing through the upper path A and the refrigerant flowing through the lower path B merge through the distributor 32, and a second temperature detecting unit 8 for detecting the refrigerant temperature of the refrigerant passing through the lower path B. The second temperature detecting unit 8 is provided upstream of the first temperature detecting unit 7 when viewed from the compressor 1 in the defrosting operation. The first temperature detecting unit 7 and the second temperature detecting unit 8 are composed of, for example, thermistors.

The first temperature detecting unit 7 detects the refrigerant temperature of the refrigerant that has passed through the entire surface of the outdoor heat exchanger 3 during the defrosting operation. On the other hand, the second temperature detecting unit 8 detects the refrigerant temperature in the vicinity of the position where the refrigerant flowing through the upper path A and the refrigerant flowing through the lower path B merge through the distributor 32. The apparatus is configured so that in the defrosting operation, the refrigerant temperature is detected as much as possible of the refrigerant which has passed through the lower path B by the second temperature detecting unit 8 to determine whether or not frost or ice is melted.

In the air-conditioning apparatus according to the present embodiment, in the heating operation, the refrigerant flowing in from the intermediate path C is branched into an upper path A and a lower path B by the distributor 32. At this time, since the gas-liquid two-phase refrigerant flowing in the upper path A flows to the upper portion of the outdoor heat exchanger 3 against the gravitational force, the flow path resistivity is large and the refrigerant flow rate is small. On the other hand, since the gas-liquid two-phase refrigerant flowing in the lower path B flows along the gravitational direction, the flow path resistance is small and the refrigerant flow rate is large. In the upper path A where the refrigerant flow rate is small, since the refrigerant easily evaporates, the temperature becomes superheated vapor in the vicinity of the outlet of the heat transfer tube 31, and the refrigerant temperature becomes high. On the other hand, in the lower path B where the refrigerant flow rate is high, the refrigerant does not evaporate completely and becomes saturated. Therefore, in the outdoor heat exchanger 3, a temperature difference may occur between the upper path A and the lower path B.

The condensation water adhering to the heat transfer fins 30 slides down between the heat transfer fins 30 by its own weight, and is discharged from the lowermost portion of the heat transfer fins 30 to the outside through the bottom plate 10*e*. In this process, the lower end of the outdoor heat exchanger 3 holds the dew condensation water in the form of water droplets by the surface tension between the heat transfer fins 30, as shown in part D in FIG. 5. At the lower ends of the heat transfer fins 30, when the temperature of the heat transfer fins 30 becomes negative, the condensation water solidifies. In the outdoor heat exchanger 3, when the condensation water freezes, clogging is caused in the space between the heat transfer fins 30, the ventilation by the fan 16 is inhibited, heat exchanging failure occurs, and the refrigerant temperatures are further lowered.

Therefore, in the air-conditioning apparatus according to the present embodiment, the control for terminating the defrosting operation is performed based on the refrigerant temperature detected by the first temperature detecting unit 7 and the refrigerant temperature detected by the second temperature detecting unit 8. Hereinafter, the control operation of the air-conditioning apparatus according to the present embodiment will be described with reference to the flow chart shown in FIG. 6.

Figure 6:
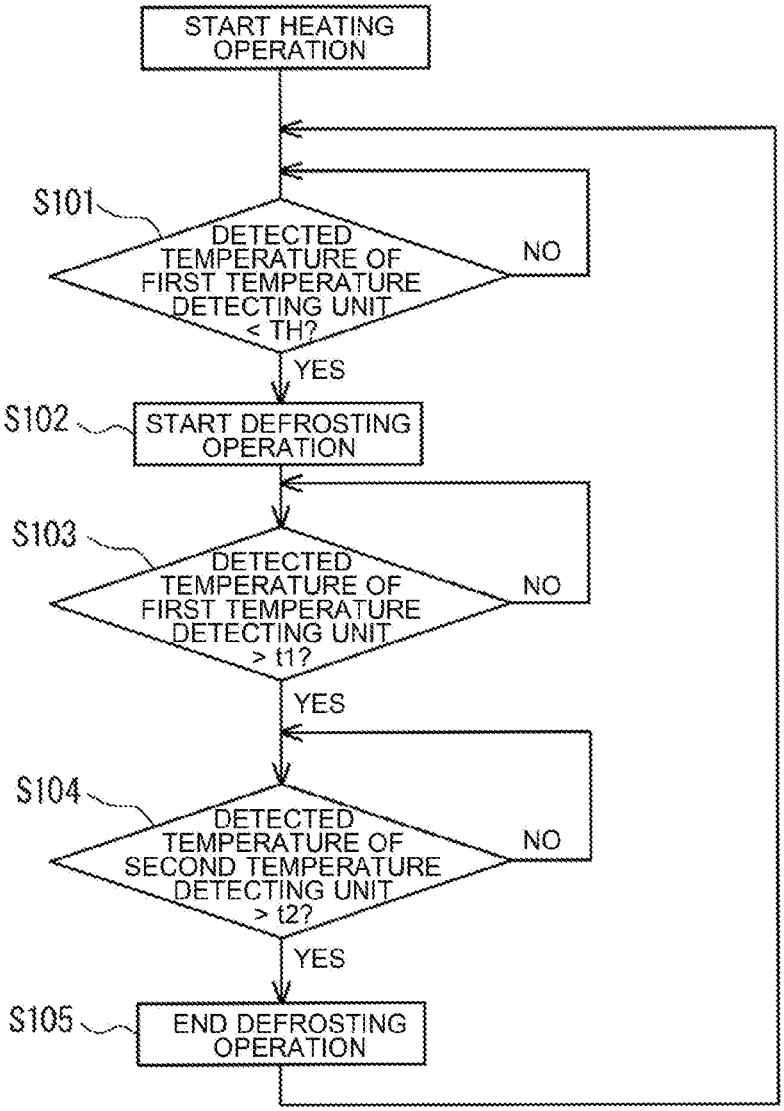
FIG. 6 is a flowchart illustrating control operation of the air-conditioning apparatus according to an embodiment of the present disclosure.

FIG. 6 is a flow chart for explaining the control operation of the air-conditioning apparatus according to the embodiment of the present disclosure. The temperature at which the frost adhering to the entire surface of the outdoor heat exchanger 3 is completely melted is referred to as a first target temperature t1. The second target temperature t2 is a temperature at which the ice adhering to the lower portion of the outdoor heat exchanger 3 is completely melted.

First, the air-conditioning apparatus starts the heating operation. In step S101, the controller 6 determines whether t<TH is satisfied in the relation between the refrigerant temperature t detected by the first temperature detecting unit 7 and the refrigerant temperature TH for starting the defrosting operation. The controller 6, when the first temperature detecting unit 7 detects the refrigerant temperature t is determined to be t<TH, proceeds to step S102, and starts the defrosting operation. On the other hand, when determining that the refrigerant temperature t detected by the first temperature detecting unit 7 does not satisfy t<TH, the controller 6 repeats the S101 of steps until t satisfies t<TH.

In step S103, the controller 6 determines whether or not the refrigerant temperature t detected by the first temperature detecting unit 7 satisfies t>t1. When determining that the refrigerant temperature t detected by the first temperature detecting unit 7 satisfies t>t1, the controller 6 proceeds to S104. On the other hand, when determining that the refrigerant temperature t detected by the first temperature detecting unit 7 does not satisfy t>t1, the controller 6 repeats the S103 of steps until t satisfies t>t1.

In step S104, the controller 6 determines whether or not the refrigerant temperature t detected by the second temperature detecting unit 8 satisfies t>t2. If it is determined that the refrigerant temperature t detected by the second temperature detecting unit 8 satisfies t>t2, the controller 6 proceeds to step S105, ends the defrosting operation, and returns to step S101. On the other hand, when determining that the refrigerant temperature t detected by the second temperature detecting unit 8 does not satisfy t>t2, the controller 6 repeats the S104 of steps until t satisfies t>t2.

Figure 7:
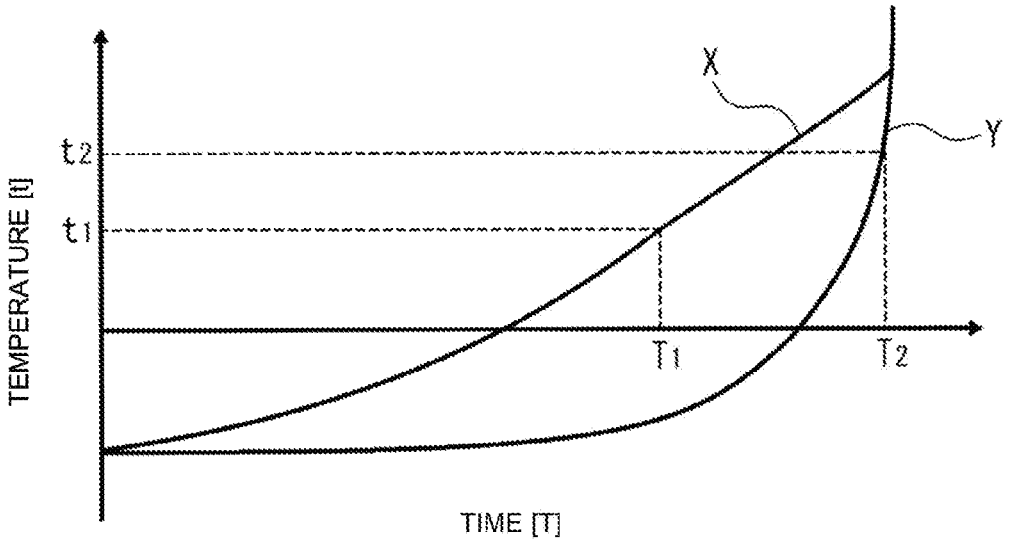
FIG. 7 shows a graph representing a time-response waveform, during defrosting operation, of the first temperature detecting unit and the second temperature detecting unit of the air-conditioning apparatus according to an embodiment of the present disclosure.
Figure 8:
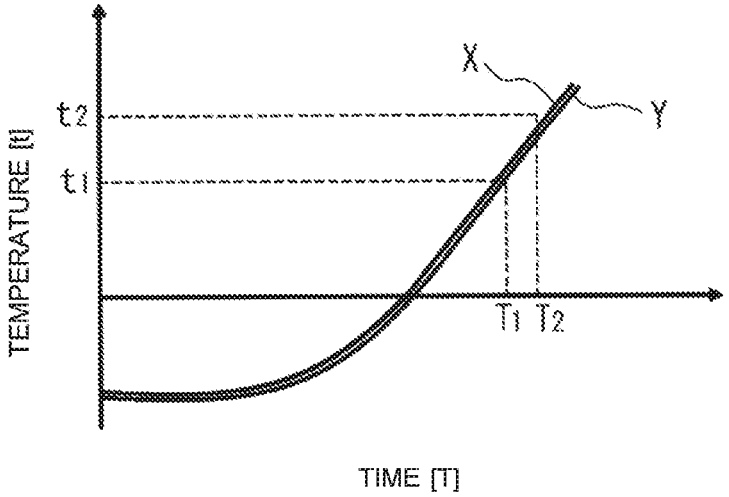
FIG. 8 is a graph showing a time-response waveform during defrosting operation of the first temperature detecting unit and the second temperature detecting unit of the air-conditioning apparatus according to an embodiment of the present disclosure.
Figure 9:
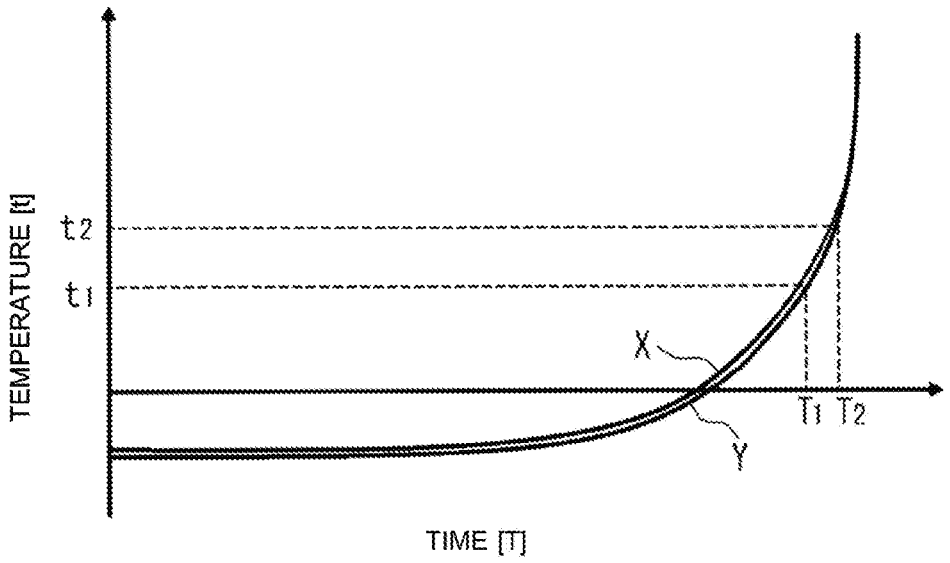
FIG. 9 is a graph showing a time-response waveform during defrosting operation of the first temperature detecting unit and the second temperature detecting unit of the air-conditioning apparatus of an embodiment of the present disclosure.

Next, time-response waveforms of the first temperature detecting unit 7 and the second temperature detecting unit 8 in the defrosting operation will be described with reference to FIGS. 7 to 9. FIGS. 7 to 9 are graphs showing time-response waveforms at the time of defrosting operation of the first temperature detecting unit and the second temperature detecting unit of the air-conditioning apparatus according to the embodiment. In FIGS. 7 to 9, the vertical axis represents temperature, and the horizontal axis represents time. A curve X represents a time response waveform of the first temperature detecting unit 7, and a curve Y represents a time response waveform of the second temperature detecting unit 8.

First, the time-response waveforms of the first temperature detecting unit 7 and the second temperature detecting unit 8 when the outside air has a positive low temperature and is humid will be described with reference to FIG. 7. The positive low temperature with high humidity means, for example, that the outside air temperature is about 5 degrees C. and the humidity is about 90%.

When the outside air has a positive low temperature and is humid, frost adhering to the lower portion of the outdoor heat exchanger 3 may grow into ice. In the defrosting operation, a large amount of heat is consumed to melt the ice generated in the lower portion of the outdoor heat exchanger 3. Therefore, the high temperature refrigerant discharged from the compressor 1 reject much heat to the outdoor heat exchanger 3. At this time, only the frost is melted by the high temperature refrigerant in the upper path A, so that the heat dissipation of the refrigerant is small. Thus, the refrigerant temperatures of the refrigerant passing through the upper path A are relatively high. On the other hand, in the lower path B, the ice needs to be melted together with the frost by the high temperature refrigerant. Thus, the refrigerant temperatures of the refrigerant passing through the lower path B are lower than those of the refrigerant passing through the upper path A.

That is, since the refrigerant temperature detected by the first temperature detecting unit 7 is such that the refrigerant flowing through the upper path A and the refrigerant flowing through the lower path B merge via the distributor 32, the temperature is pulled to the refrigerant temperature of the refrigerant flowing through the upper path A as shown by the curve X in FIG. 7, and the refrigerant temperature rises faster after the merge. On the other hand, the rise of refrigerant temperature detected by the second temperature detecting unit 8 is slower than the temperature rise detected at the first temperature detecting unit 7, as shown by a curve Y in FIG. 7.

Therefore, in the air-conditioning apparatus of the present embodiment, the defrosting operation is performed until the time T2 at which the temperature detected by the second temperature detecting unit 8 becomes t2, so that the defrosting operation is extended for a predetermined time from the time T1, and the capability of melting ice is enhanced.

Next, time-response waveforms of the first temperature detecting unit 7 and the second temperature detecting unit 8 when the outside air has a very low temperature and the absolute humidity is low will be described with reference to FIG. 8. The cryogenic temperature is, for example, an outside air temperature of about −10 degrees C. When the outside air has a very low temperature and has a low absolute humidity, almost no frost adheres to the outdoor heat exchanger 3 during the heating operation, and therefore, as shown in FIG. 8, the time response waveform X of the first temperature detecting unit 7 and the time response waveform Y of the second temperature detecting unit 8 are substantially similar to each other. In addition, since the frost hardly adheres, it is not necessary to melt the frost by the defrosting operation. Therefore, there is little difference between the time T1 for determining the end of the defrosting operation in the detection value of the first temperature detecting unit 7, and the time T2 for determining the end of the defrosting operation in the detection value of the second temperature detecting unit 8. Hence, even if the defrosting operation is performed until time T2, the defrosting operation is not greatly extended.

Next, time-response waveforms of the first temperature detecting unit 7 and the second temperature detecting unit 8 when the outside air has a low temperature and is humid will be described with reference to FIG. 9. For example, the low temperature and high humidity means that the outside air temperature is about 0 degrees C. and the humidity is about 90%. In this case, since the temperature of the entire surface of the outdoor heat exchanger 3 during the heating operation becomes 0 degrees C., frost adheres to the entire surface of the outdoor heat exchanger 3. Therefore, in the outdoor heat exchanger 3, since the ventilation is inhibited, the evaporating temperature of the refrigerant is quickly lowered. Therefore, the defrosting operation is performed before the frost adhering to the lower portion of the outdoor heat exchanger 3 grows into ice.

When the outside air has a low temperature and is humid, the time response waveform X of the first temperature detecting unit 7 and the time response waveform Y of the second temperature detecting unit 8 are substantially the same as shown in FIG. 9. Therefore, there is little difference between the time T1 for determining the end of the defrosting operation in the detection value of the first temperature detecting unit 7, and the time T2 of the end determination of the defrosting operation in the detection value of the second temperature detecting unit 8. Hence, even if the defrosting operation is performed till time T2, the defrosting operation is not greatly extended.

As described above, according to the air-conditioning apparatus of the present embodiment, in the defrosting operation, when the refrigerant temperature detected by the first temperature detecting unit 7 reaches the first target temperature t1 and the refrigerant temperature detected by the second temperature detecting unit 8 reaches the second target temperature t2, the defrosting operation is terminated. Therefore, when ice is generated in the lower portion of the outdoor heat exchanger 3, the defrosting operation is extended until the refrigerant temperature detected by the second temperature detecting unit 8 reaches the second target temperature t2, and the capability of melting ice is enhanced. On the other hand, when ice is not generated in the lower portion of the outdoor heat exchanger 3, the defrosting operation is hardly extended because the difference between the refrigerant temperature detected by the first temperature detecting unit 7 and the refrigerant temperature detected by the second temperature detecting unit 8 is very small. Therefore, in this air-conditioning apparatus, ice can be effectively melted when ice is generated in the lower part of the outdoor heat exchanger 3, and unnecessary defrosting operation is not performed unless ice is generated in the lower part of the outdoor heat exchanger 3, so that the defrosting operation can be performed for the necessary minimum duration.

The second temperature detecting unit 8 in the present embodiment detects the refrigerant temperature in the vicinity of the position where the refrigerant flowing through the upper path A and the refrigerant flowing through the lower path B merge through the distributor 32. Therefore, in the air-conditioning apparatus according to the present embodiment, since the second temperature detecting unit 8 can detect the refrigerant temperature passing through the lower path B during the defrosting operation, it is possible to reliably determine whether or not the frost or the ice is melted.

It should be noted that, in air-conditioning apparatuses, when the volume of the outdoor heat exchanger is large, even if the heating operation is performed when the outside air temperature is about 5 degrees C. and the humidity is about 90% at a positive low temperature, the evaporating temperature of the refrigerant doesn't tend to become negative, and therefore, the frosting amount is very small. However, in the case of the air-conditioning apparatus, if the volume of the outdoor heat exchanger is designed to be small because the width of the heat transfer fin is short, the number of rows of the heat transfer fin is small, or the height of the heat transfer fin is low, the evaporating temperature of the refrigerant may be low during the heating operation, and the temperature may be lowered to about 0 degrees C. In the air-conditioning apparatus according to the present embodiment, even in the configuration having such an outdoor heat exchanger with a small volume, the defrosting operation can be performed for the minimum necessary duration as described above.

Although the present disclosure has been described above based on the embodiment, the present disclosure is not limited to the configuration of the embodiment described above. For example, the air-conditioning apparatus may include other components in addition to the compressor 1, the four-way valve 2, the outdoor heat exchanger 3, the expansion valve 4, and the indoor heat exchanger 5. In short, it is noted that the scope of various modifications, applications, and uses, which are done or made by those skilled in the art as necessary, is included in the gist (technical scope) of the present disclosure.

REFERENCE SIGNS LIST

1 compressor, 2 four-way valve, 3 outdoor heat exchanger, 4 expansion valve, 5 indoor heat exchanger, 6 controller, 7 first temperature detecting unit, 8 second temperature detecting unit, 10 casing, 10*a* front panel, 10*b* right side panel, 10*c* right side cover, 10*d* rear panel, 10*e* bottom panel, 10*f* top plate, 11 fan grille, 12 partition plate, 13 fan chamber, 14 machine chamber, 15 mounting plate, 16, 17 fan, 30 heat transfer fins, 30*a* heat transfer tube insertion hole, 31 heat transfer tube, 32*a* first branch tube, 32*b* second branch tube, 32*c* connecting pipe, 100 room outdoor tube, 101 refrigeration cycle, A upper path, B lower path, t1 first target temperature, t2 second target temperature.

The invention claimed is:

1. An air-conditioning apparatus including a refrigeration cycle in which a compressor, a four-way valve, an outdoor heat exchanger, an expansion valve, and an indoor heat exchanger are connected in order by refrigerant pipes to circulate refrigerant, wherein the outdoor heat exchanger includes a plurality of heat transfer fins arranged in parallel at intervals, a heat transfer tube connected with and penetrating through the plurality of heat transfer fins and having a plurality of paths in the vertical direction of the plurality of heat transfer fins, a distributor configured to branch, at a vertically intermediate portion of the plurality of heat transfer fins, a refrigerant flow path of the heat transfer tube into a vertically upper path and a vertically lower path, a first temperature detector configured to detect a temperature of merged refrigerant into which refrigerant flowing through the vertically upper path and refrigerant flowing through the vertically lower path merge through the distributer, a second temperature detector configured to detect a refrigerant temperature of the refrigerant passing through the vertically lower path, and a controller configured to perform control to terminate defrosting operation when the refrigerant temperature detected by the first temperature detector reaches a first target temperature and the refrigerant temperature detected by the second temperature detector reaches a second target temperature during the defrosting operation.

2. The air-conditioning apparatus of claim 1, wherein the second temperature detector detects the refrigerant temperature in a vertically upper portion of the vertically lower path.

* * * * *